US012808139B2

(12) United States Patent
Abou El Hosn et al.

(10) Patent No.: US 12,808,139 B2
(45) Date of Patent: Nov. 24, 2026

(54) HOOK, HOOK PILE FOUNDATION SYSTEM AND ITS APPLICATION THEREOF

(71) Applicants: Ghazi Abou El Hosn, Newmarket (CA); Mohammad Tofigh Rayhani, Ottawa (CA)

(72) Inventors: Ghazi Abou El Hosn, Newmarket (CA); Mohammad Tofigh Rayhani, Ottawa (CA)

( * ) Notice: Subject to any disclaimer, the term of this patent is extended or adjusted under 35 U.S.C. 154(b) by 365 days.

(21) Appl. No.: 18/534,583

(22) Filed: Dec. 9, 2023

(65) Prior Publication Data

US 2024/0200299 A1 Jun. 20, 2024

Related U.S. Application Data

(60) Provisional application No. 63/432,558, filed on Dec. 14, 2022.

(51) Int. Cl.
*E02D 5/54* (2006.01)

(52) U.S. Cl.
CPC ..... *E02D 5/54* (2013.01)

(58) Field of Classification Search
CPC ..... E02D 5/54; E02D 5/803
See application file for complete search history.

(56) References Cited

U.S. PATENT DOCUMENTS 1,982,687 A * 12/1934 James ..... E02D 5/54 405/257
6,435,777 B1 8/2002 Yoshii et al.
10,309,073 B1 6/2019 Beck

FOREIGN PATENT DOCUMENTS

CN 107217665 A 9/2017
CN 111764422 A 10/2020
SE 1550905 A1 * 12/2016 ..... E02D 5/805

OTHER PUBLICATIONS

Ghazi Abou El Hosn, 2015, Enhancement of Shaft Capacity of Cast-in-Place Piles using a Hook System, A thesis submitted to the Faculty of Graduate and Postdoctoral Affairs in partial fulfillment of the requirements for the degree of: Master of Applied Science in Civil Engineering Carleton University, Ottawa, Ontario.

* cited by examiner

*Primary Examiner* — Kyle Armstrong
(74) *Attorney, Agent, or Firm* — Lamson IP

(57) ABSTRACT

Provided herein is a hook that is attachable to an exterior of a cage, which cage is for insertion into a hole in the ground to form a pile, the hook being moveable into an open position in which the hook extends outwardly from the cage, and the hook comprising a piston for moving the hook into at least the open position in response to a motive force. Further provided is a cage in which a plurality of such hooks is mounted and a kit comprising the plurality of hooks with instructions for use of same.

18 Claims, 6 Drawing Sheets

HOOK, HOOK PILE FOUNDATION SYSTEM AND ITS APPLICATION THEREOF

CROSS-REFERENCE TO RELATED APPLICATIONS

This application claims priority from U.S. provisional patent application No. 63/432,558 filed on Dec. 14, 2022, which is incorporated herein by reference in its entirety.

TECHNICAL FIELD

The present disclosure is directed to a new deep foundation system, which improves the load transfer and settlement of cast-in-place piling through implementing hooks/anchors at the perimeter of the pile.

BACKGROUND

Deep foundations, also known as pile foundations, are widely used throughout the world as the preferred foundation system to resist the upwards and downwards heavy load structures both onshore and offshore. Piles are normally installed either by driving through the ground strata or through drilling a hole and filling the hole with reinforced concrete (cast-in-place). Cast-in-place piling is known as the most flexible and practical method in piling construction as it can be used in any diameters and up to any practical depth.

The load carrying capacity of pile foundations is provided by the toe bearing capacity as well as the pile shaft capacity through the pile-soil interface resistance. The shaft capacity of cast-in-place piles may not be fully developed in caving soils and fractured rocks due to possible gap between the pile and the surrounding ground materials. The process of construction of cast-in-place piles may also reduce the pile-soil interface strength as the drilling operation and the type of drilling tools play a major role in the shaft interface resistance. Concrete water has also shown to reduce the shaft capacity of cast-in-place piles in clay soils.

Several techniques have been attempted to improve the pile-soil interface strength and, hence, the shaft capacity of cast-in-place piles. These techniques include using expansive concrete to fill possible voids between the pile and the surrounding material, enlargement of the base of the pile to increase the uplift and base load capacity, and implementing cutting grooves around the socket wall of the pile to increase the pile surface roughness and consequently the pile shaft capacity. Although some of these techniques are useful in certain applications, they are not widely implemented in the piling industry due to their limitations and drawbacks. Enlargement of the base of the pile does not improve the shaft capacity of the pile under compressional loads. Cutting grooves, on the other hand, cannot be implemented in the cast-in-place piles as the concrete is poured in the field and the surface roughness is governed by the concrete-soil interaction. Using expansive concrete can fill the possible gaps around the pile, but its capability in improving the shaft capacity is limited to that of the concrete-soil interface strength.

Considering the weak interface strength between concrete and the surrounding soil in cast-in-place piles, many designers rely on the toe bearing capacity and ignore the full contribution of the shaft capacity. This conservative approach leads to the use of a greater number of piles and/or larger pile length/diameters than is required, resulting in higher costs for pile and infrastructure construction. Therefore, there exists a need for a method to enhance the load transfer and/or settlement of drilled pile foundations, that is adaptable to different load sizes/configurations and/or that is applicable for different geological settings.

SUMMARY

This disclosure in some embodiments relates to pile foundations of the type with passive anchoring systems installed at their shaft surface. In certain embodiments, the anchoring systems herein may increase the performance of such piles while reducing the general cost associated with installing a piling. The disclosure employs a series of hooks (e.g., anchors) mounted on the perimeter of steel cages used in cast-in-place piles, which are powered to extend into the surrounding ground material(s) and provide load resistance. Such powering may be provided by a piston and pressure system within the hook elements that functions to actuate them into opened and optionally closed positions. A quickly attachable/detachable hook system with a flexible configuration disclosed in certain embodiments herein is readily adaptable for various types of loads (e.g., upward and downward) and ground materials (e.g., soil and rock). Thus, the present disclosure in some embodiments provides a novel and efficient system, which is applicable in wide range of piling applications.

In one aspect, the present disclosure provides a hook attachable to an exterior of a cage, which cage is for insertion into a hole in the ground to install a pile foundation, the hook being moveable into an open position in which the hook extends outwardly from the cage, the hook comprising a piston for moving the hook into at least the open position in response to a motive force.

In one embodiment, the motive force is provided by an air pressure system that functions to introduce air from a compressor into the piston assembly to cause a shaft of the piston assembly to extend, thereby moving the hook into the open position.

In another embodiment, the motive force is provided by a hydraulic system that functions to introduce a liquid into the piston to cause a shaft of the piston assembly to extend, thereby moving the hook into the open position.

In another embodiment, the hook comprises a distal end connected to a piston shaft of the piston and wherein, when the shaft is extended, the distal end moves into an extended position, thereby causing the hook to move outwardly into the open position.

In another embodiment, the hook comprises a proximal end that is attachable to the cage. In another embodiment, the hook is made of a material that is flexible.

In another embodiment, the distal end is capable of moving inwardly in response to withdrawal of air or a liquid.

In another aspect, there is provided a cage comprising a plurality of hooks attached to an exterior of a cage, which cage is for insertion into a hole in the ground to form a pile foundation, the plurality of hooks being moveable into open positions in which the plurality of hooks extends outwardly from the cage, the hooks comprising respective pistons for moving the hooks into at least the open position in response to a motive force.

In a further embodiment, the motive force is provided by an air pressure system that functions to introduce air from a compressor into the piston assembly to cause a shaft of each piston to extend, thereby moving the hooks into the open position.

In another embodiment, the motive force is provided by a hydraulic system that functions to introduce a liquid into each piston to cause a shaft of the piston of each hook to extend, thereby moving the hooks into open positions.

In yet another embodiment, each hook of the plurality of hooks comprises a distal end connected to a respective piston shaft of the piston of each hook and wherein, when the shaft of each piston is extended, the respective distal ends move into extended positions, thereby causing the hooks to move outwardly into open positions.

In a further embodiment, each hook comprises a proximal end that is attachable to the cage.

In a further embodiment, the plurality of hooks are made of a material that is flexible to move to the open positions.

According to another embodiment, the distal end of each hook is capable of moving inwardly in response to withdrawal of air or a liquid.

In a further embodiment, there is provided a kit comprising a plurality of hooks attachable to an exterior of a cage, which cage is for insertion into a hole in the ground to form a pile, the plurality of hooks being moveable into an open position in which each hook of the plurality thereof extends outwardly from the cage, and each hook of the plurality of hooks comprising an actuator for moving the hooks into at least the open position in response to a motive force; and instructions for mounting the plurality of hooks on the cage.

In a further embodiment, the instructions include: (i) how many hooks to install on the cage; (ii) how to mount the hooks on the cage; (iii) the arrangement of the hooks on the perimeter of the cage; and/or (iv) the orientation of the hooks.

In a further embodiment, the kit further comprises instructions on how to adjust any one of (i) to (iv) above based on a type of structure the foundation is used for supporting.

In a further embodiment, the kit further comprises a system comprising lines for introducing the motive force to each actuator.

In a further embodiment, each actuator is a piston configured to install lines that are part of an air pressure system or a hydraulic system.

In another embodiment, the kit further comprises instructions for installing an air pressure system or hydraulic system to power each actuator.

BRIEF DESCRIPTION OF THE DRAWINGS

Various other features and advantages of this disclosure will be apparent and better understood by reference to the following detailed description when considered in connection with the accompanying figures, wherein.

DETAILED DESCRIPTION

Figure 1A:
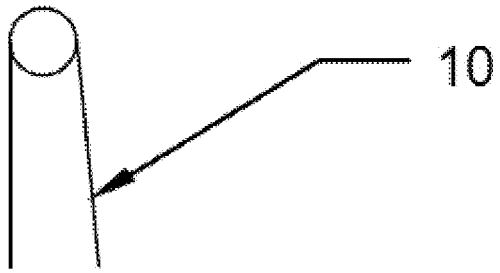
FIG. 1A is a simplified view of a hook of the present disclosure for installation on a steel cage.

The disclosure presented herein provides a foundation system 5 providing hook(s) 10 at the surface of steel cages of the type used in cast-in-place piles. The details of the foundation system 5 are shown in FIG. 1-4. The hook 10 is shown in FIG. 1A and may be made of a prefabricated hard steel bars or of any other sufficiently rigid and strong material such as high-strength plastic, metal, and the like. Further, the various components of the hook 10 can be made of different materials and can have a variety of different shapes.

Figure 1B:
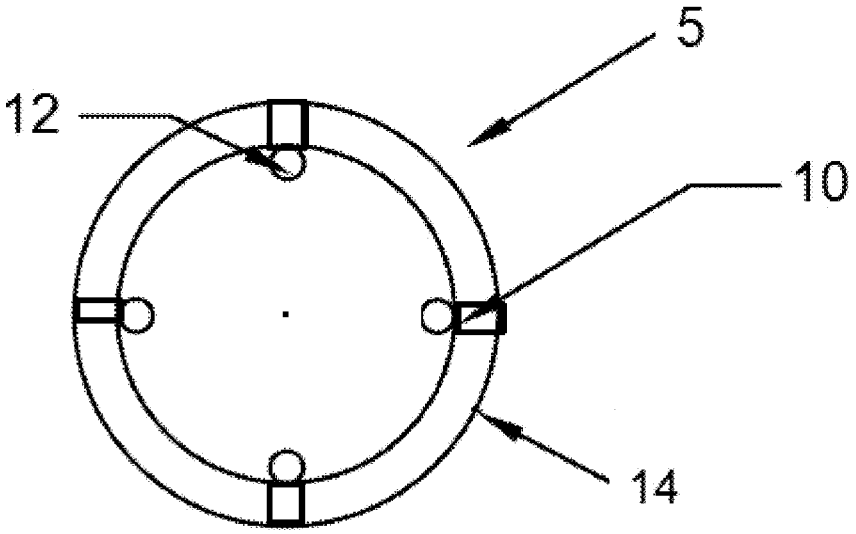
FIG. 1B is a simplified view of the present disclosure showing the hook foundation system installed on the perimeter of a steel cage of the type used in cast-in-place piles.
Figure 2:
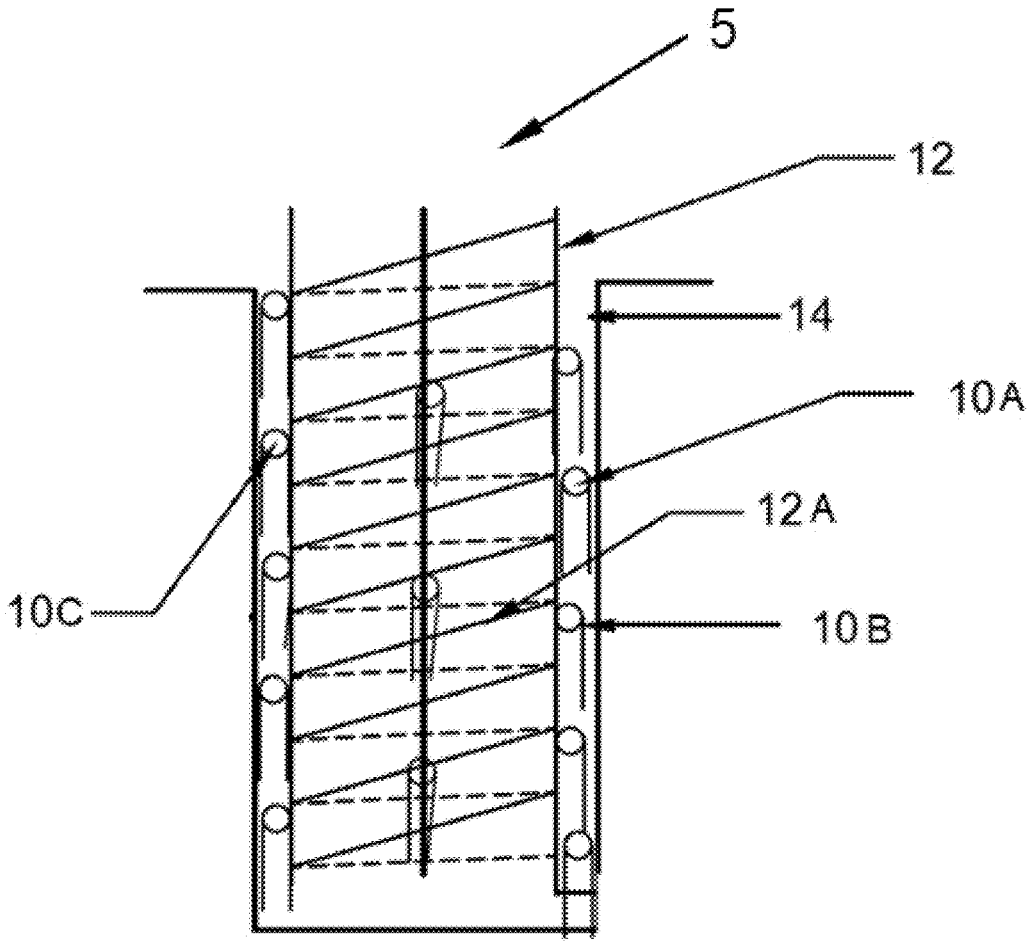
FIG. 2 shows the foundation system installed on perimeter of the steel cages during placement of the cage within the drilled hole when the hooks are closed.

Referring to the disclosure in more detail, in FIG. 1B there is shown a schematic of the foundation system 5, shown in cross-section, with a hook 10 connected to a reinforcing steel cage 12 used in a cast-in-place piling. In FIG. 2 there is shown a plurality of hooks 10A, 10B and 10C connected to the exterior of the reinforcing steel cage 12 comprising spiral reinforcement 12A of the type used in drilled piles. The plurality of hooks 10A, 10B and 10C are in their closed form when the steel cage 12 is installed within a drilled hole 14. The number of the plurality of hooks 10A, 10B and 10C, as well as their corresponding location, can be adjusted based on the size of the load applied to the pile and the type and shear strength behaviour of the surrounding ground materials.

Figure 3:
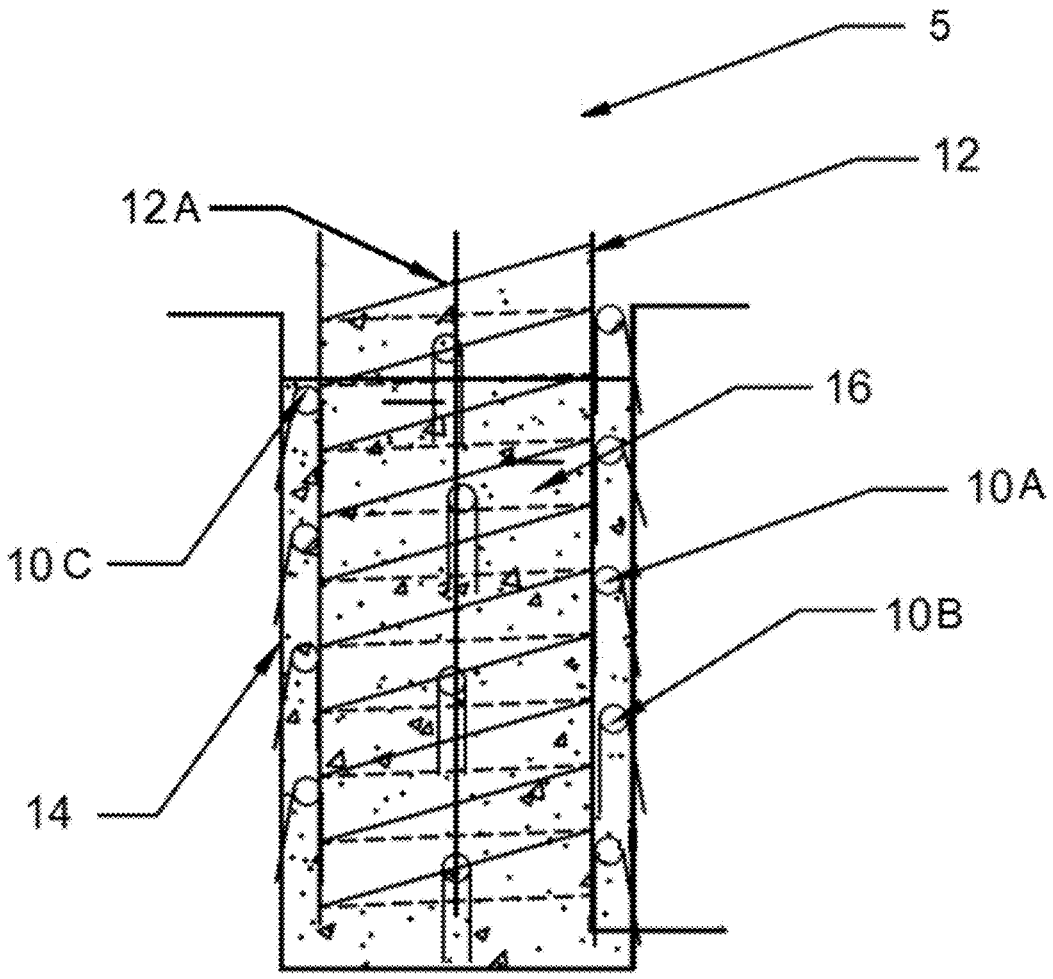
FIG. 3 is a simplified complete hook pile after installation of the hooks, opening them in the drilled hole, and pouring concrete into the drilled hole.

As shown in more detail, with reference to the embodiment of FIG. 3, the configuration of the hooks 10 within the foundation system 5 is shown after installation of the reinforcing cage 12 in the drilled hole 14. The hooks 10 have an actuating mechanism enabling them to be pushed into the surrounding drilled hole 14 to bond and engage with the surrounding ground material. A piston and pressure system, shown in more detail in FIGS. 5A-D and FIGS. 6A and 6B, may be provided within the plurality of hooks, e.g., 10A, 10B and 10C, to open and close them. For downward loading, the plurality of hooks, e.g., 10A, 10B and 10C, are installed in a downward direction, thereby opening downwardly, for a compression passive inclusion reaction. Concrete 16 is poured into the drilled hole 14 subsequent to installation of the cage 12 and opening of the hooks 10, thereby completing installation of the hook pile foundation.

Figure 4:
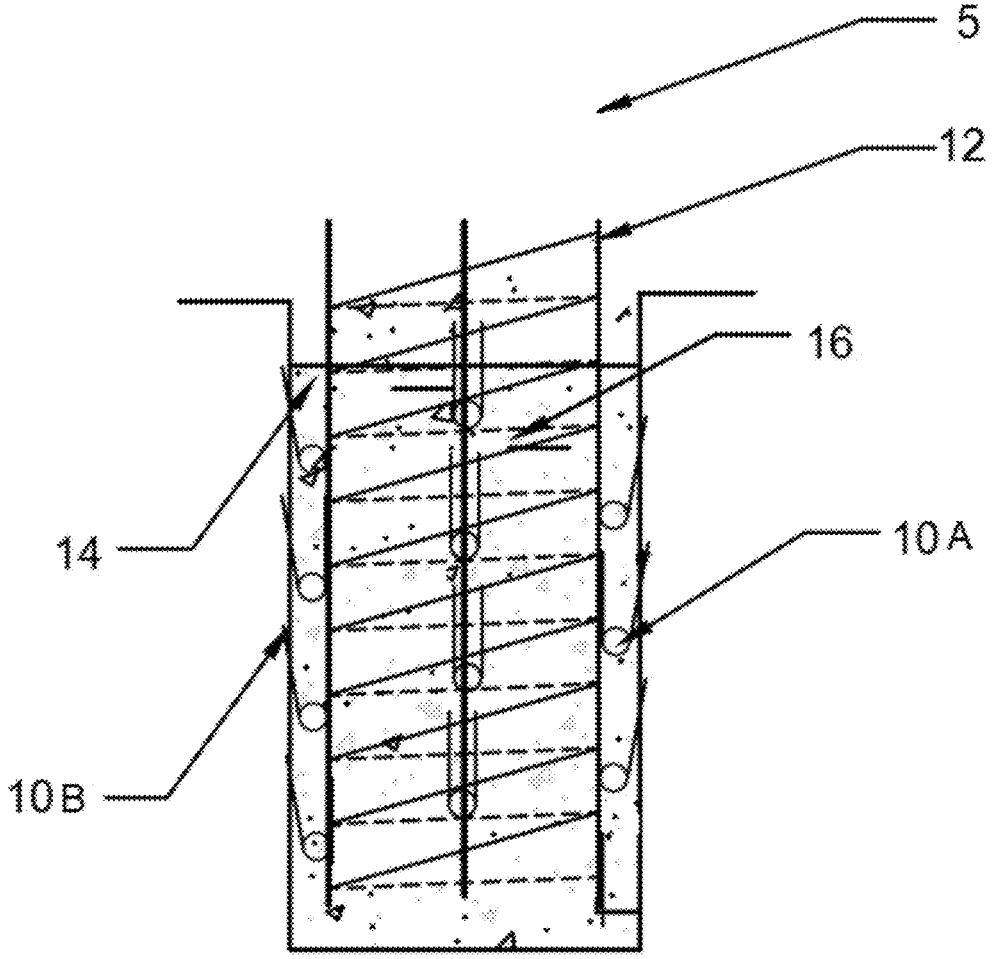
FIG. 4 is a view of the plurality hooks around the steel cage when configured for upward loading in the drilled hole.

FIG. 4 depicts an alternative embodiment of a hook foundation system 5 comprising a plurality of hooks (e.g., 10A, 10B, etc.) for upward loading. The upwardly opening hooks, in such embodiments, open upwardly (FIG. 4) to provide passive anchoring resistance against upward loads. For example, pile foundations are often used to resist the upward loads arising from structural moments induced in high-rise buildings and wind turbines. Further examples include upward loads induced by wind in offshore structures, by earthquakes or lateral loads induced by waves.

The plurality of hooks (e.g., 10A, 10B, 10C, etc.) may be installed around the perimeter of the steel cage 12 in a staggered arrangement at equal distances along with the steel bars (e.g., rebar) of the pile reinforcing cage 12 (FIGS. 2-4). Upon installation of the cage 12 and opening of the plurality of hooks, e.g., 10A, 10B, 10C, etc., concrete 16 is poured within the pile hole 14 to complete the installation of the hook pile (FIG. 3-4).

The advantages of embodiments of the present disclosure include, without limitation, improvements in pile-soil interface strength, higher load carrying capacity and/or minimal pile settlement, thereby resulting in lower piling cost. The installation process of the plurality of hooks, e.g., 10A, 10B and 10C is simple and not expected to affect the pile installation time since the plurality of hooks, e.g., 10A, 10B, 10C, etc. are fixed on the rebar of the steel cage 12 while preparing same. Further, the plurality of hooks, e.g., 10A, 10B, 10C, etc., can easily be installed in different directions to accommodate various types of loads.

In one embodiment, the disclosure provides a hook foundation system 5 mounted on the exterior of drilled and cast-in-place piles for passive anchoring and enhanced pile load transfer performance. Such passive hook foundation systems 5 are capable of improving the pile-soil interface strength by anchoring the hook pile to the surrounding soil/rock materials. Preliminary results obtained from interface shear tests have shown that the interface shear strength parameters under both drained and undrained conditions significantly increase when hooks are implemented at the interface level. Preliminary load tests have also demonstrated an increase in pile shaft capacity from about 32 kN to over 50 kN when only five hooks were implemented at the surface of a small-scale pile with 1 m length and 200 mm diameter. The hook foundation system 5 also reduced the pile settlement significantly showing a reduction from 12 mm to less than 5 mm when five hooks were used in the hook pile.

Figure 5A:
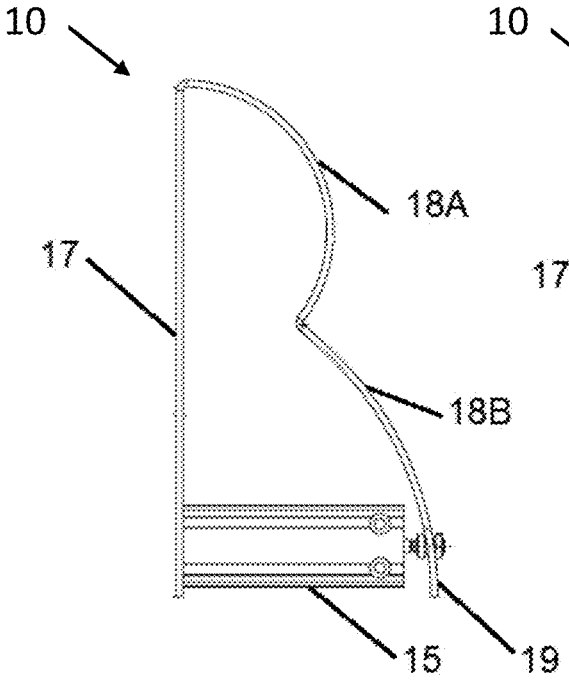
FIG. 5A is a side view of a hook comprising a piston in a closed position.
Figure 5B:
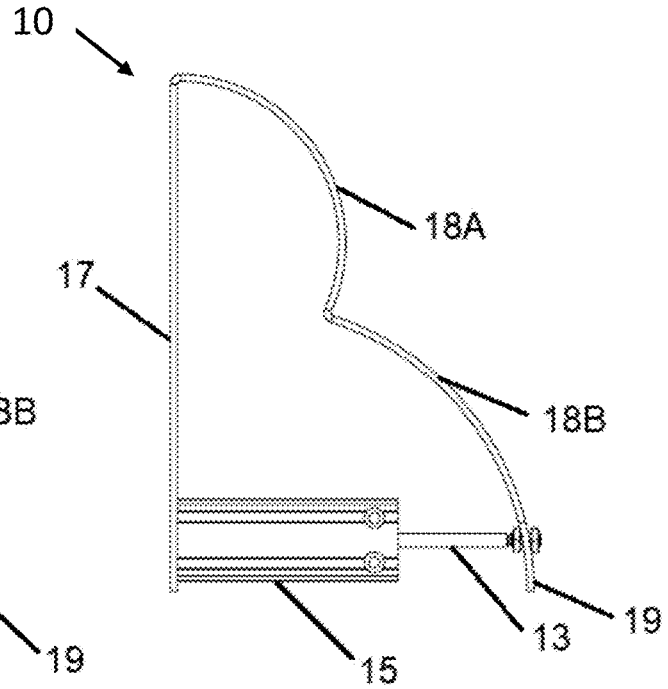
FIG. 5B is a side view of a hook comprising a piston in an open position.
Figure 5C:
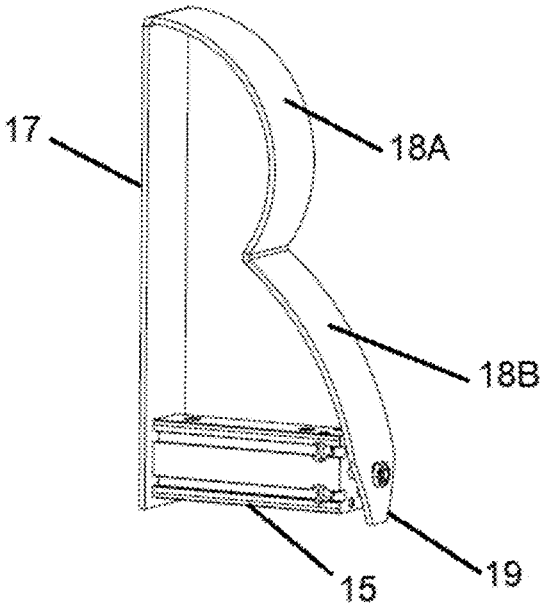
FIG. 5C is a side elevational view of a hook comprising a piston in a closed position.
Figure 5D:
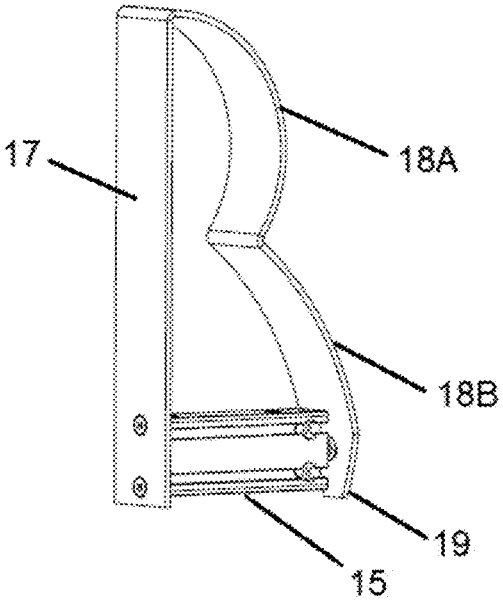
FIG. 5D is a further side elevational view of a hook comprising a piston in a closed position.

FIGS. 5A and 5B show a hook 10 in which powering to actuate the hook in an open position is provided by a piston 15 within the hook 10. In this embodiment, the hook is a steel bar and the distal end 19 of the hook 10 is attached to a piston shaft 13 (via a fastener such as a bolt) of the piston 15 and a proximal portion 17 is welded to the cage 12. As the shaft 13 extends outside a piston chamber thereof, the distal end 19 follows and extends the hook 10 into the open position shown in FIG. 5B. In this embodiment, the hook 10 is made of material (e.g., metal bars) that is sufficiently flexible to move into the open and closed positions. The hook 10 may comprise two arcuate portions 18A and 18B to facilitate outward/inward movement of the distal end 19 of the hook 10 when mounted on the cage 12. FIGS. 5C and 5C show additional side perspective views of the hook 10 powered by the piston 15 (in a closed position).

Figure 6A:
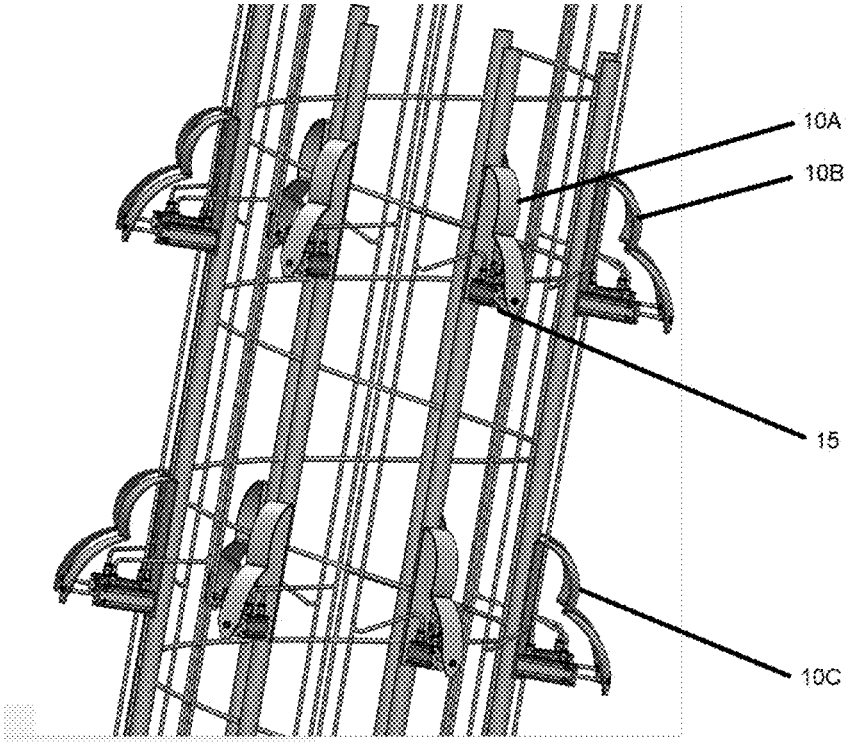
FIG. 6A is an elevational view of the foundation system comprising a plurality of the hooks with the pistons.
Figure 6B:
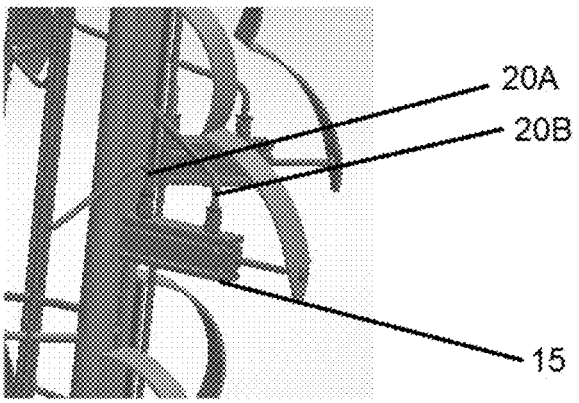
FIG. 6B is an elevation view of one of the hooks of FIG. 6A showing the air compression inlet and outlet lines.

FIGS. 6A and 6B show a plurality of hooks with respective pistons shown as 10A, 10B and 10C, welded to rebar of the cage 12. Two lines are attached to each piston 15. FIG. 6B shows the lines of hook 10A in more detail, in particular, inlet line 20A and outlet line 10B. The lines 20A and 20B are connected to an air pressure source (e.g., an air compressor) that introduces air pressure to the piston 15 via line 20A and withdraws air via line 20B. It should be understood that any motive force, including a hydraulic system could function to open and close the hook 10A. In the case of air, the introduction of air to a chamber of the piston 15 causes the piston shaft 13 (FIG. 5A-D) to extend outwardly from the chamber of the piston 15 (as shown in FIG. 5B) and open the hook 10A and withdrawal of air causes the piston shaft 13 to retract due to the withdrawal of air from the chamber of the piston 15 (see FIGS. 5A, 5C and 5D) and move the hook 10A into the closed position. It should be appreciated that the piston 15 need only function to open the hook, in which case only one inlet line 20A to introduce air would need to be provided to the piston 15. However, it may be advantageous to include both inlet 20A and outlet 20B lines since this allows the user to adjust the position of the hooks by opening and closing same until a desired degree of hook extension is achieved.

The cage comprising the hooks may improve the pile shaft capacity significantly, while minimizing the pile axial settlement. Moreover, using such hooks in some embodiments may reduce the general cost of piling by reducing the number of piles, pile diameter/length, and/or subsequently construction cost.

In some embodiments, the disclosure provides a kit that provide instructions for installation of the hooks. This may include instructions on (i) how many hooks to install on the cage; (ii) how to install the hooks on the cage (e.g., by welding to rebar of the cage 12); (iii) the arrangement of the hooks on the perimeter cage; and/or the orientation of the hooks (upwardly or downwardly). The kit may further include instructions on how to adjust any one of (i) to (iv) above based on the nature of the end use, such as the type of structure the pile foundation is to be used for supporting.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above-described embodiment, method, and examples, but by all embodiments and methods within the scope and spirit of the disclosure.

We claim:

1. A hook attachable to an exterior of a cage, which cage is for insertion into a hole in the ground to install a pile foundation, the hook being moveable into an open position in which the hook extends outwardly from the cage, the hook comprising a piston for moving the hook into an open and closed position in response to a motive force provided by a liquid or air, wherein the hook comprises a distal end connected to a piston shaft of the piston and wherein, when the shaft is extended, the distal end is movable into the open position, thereby causing the hook to move outwardly into the open position via inflow of the liquid or air into an inlet in the piston and wherein the distal end is movable into the closed position via outflow of the liquid or air in an outlet in the piston.

2. The hook of claim 1, wherein the motive force is provided by an air pressure system that functions to introduce air from a compressor into the piston assembly to cause a shaft of the piston assembly to extend, thereby moving the hook into the open position.

3. The hook of claim 1, wherein the motive force is provided by a hydraulic system that functions to introduce a liquid into the piston to cause a shaft of the piston assembly to extend, thereby moving the hook into the open position.

4. The hook of claim 1, wherein the hook comprises a distal end connected to a piston shaft of the piston and wherein, when the shaft is extended, the distal end moves into an extended position, thereby causing the hook to move outwardly into the open position.

5. The hook of claim 4, wherein the hook comprises a proximal end that is attachable to the cage.

6. The hook of claim 1, wherein the hook is made of a material that is flexible.

7. The hook of claim 4, wherein the distal end is capable of moving inwardly in response to withdrawal of air or a liquid.

8. A cage comprising a plurality of hooks attached to an exterior of a cage, which cage is for insertion into a hole in the ground to form a pile foundation, the plurality of hooks being moveable into open and closed positions in which the plurality of hooks extends outwardly from the cage, the hooks comprising respective pistons for moving the hooks into the open and closed positions in response to a motive force, the motive force provided by a liquid or air, wherein each hook comprises a distal end connected to a piston shaft of the piston and wherein, when the shaft is extended, the distal end is movable into the open position, thereby causing each hook to move outwardly into the open position via inflow of the liquid or air into an inlet in the piston and wherein the distal end is movable into the closed position via outflow of the liquid or air in an outlet in the piston.

9. The cage of claim 8, wherein the motive force is provided by an air pressure system that functions to introduce air from a compressor into the piston assembly to cause a shaft of each piston to extend, thereby moving the hooks into the open position.

10. The cage of claim 8, wherein the motive force is provided by a hydraulic system that functions to introduce a liquid into each piston to cause a shaft of the piston of each hook to extend, thereby moving the hooks into open positions.

11. The cage of claim 1, wherein each hook comprises a proximal end that is attachable to the cage.

12. The cage of claim 8, wherein the plurality of hooks are made of a material that is flexible to move to the open positions.

13. A kit comprising a plurality of hooks attachable to an exterior of a cage, which cage is for insertion into a hole in the ground to form a pile, the plurality of hooks being moveable into an open position and closed position in which each hook of the plurality thereof extends outwardly or inwardly from the cage, and each hook of the plurality of hooks comprising a piston for moving the hooks into the open position or closed position in response to a motive force, the motive force provided by a liquid or air, wherein each hook comprises a distal end connected to a piston shaft of the piston and wherein, when the shaft is extended, the distal end is movable into the open position, thereby causing each hook to move outwardly into the open position via inflow of the liquid or air into an inlet in the piston and wherein the distal end is movable into the closed position via outflow of the liquid or air in an outlet in the piston; and instructions for mounting the plurality of hooks on the cage.

14. The kit of claim 13, wherein the instructions include: (i) how many hooks to install on the cage; (ii) how to mount the hooks on the cage; (iii) the arrangement of the hooks on the perimeter of the cage; and/or (iv) the orientation of the hooks.

15. The kit of claim 14, further comprising instructions on how to adjust any one of (i) to (iv) above based on a type of structure the foundation is used for supporting.

16. The kit of claim 13 further comprising a system comprising lines for introducing the motive force to each piston.

17. The kit of claim 16, wherein each actuator is a piston configured to install lines that are part of an air pressure system or a hydraulic system.

18. The kit of claim 17, further comprising instructions for installing an air pressure system or hydraulic system to power each piston.

* * * * *